US006022056A

United States Patent [19]

Cope et al.

[11] Patent Number: 6,022,056

[45] Date of Patent: Feb. 8, 2000

[54] METHOD AND APPARATUS FOR AUTOMATED DOOR LATCH ACTUATOR

[75] Inventors: Richard D. Cope, Sparks; Sam N. Kumar, Reno, both of Nev.

[73] Assignee: Securitron Magnalock Corporation, Sparks, Nev.

[21] Appl. No.: 09/004,767

[22] Filed: Jan. 9, 1998

[51] Int. Cl.[7] ..... E05C 1/06

[52] U.S. Cl. ..... 292/144; 292/341.15; 292/341.16; 292/333

[58] Field of Search ..... 292/DIG. 72, 341.15, 292/341.16, 332, 333, 144, 340, 39

[56] References Cited

U.S. PATENT DOCUMENTS

| | | | |
|---|---|---|---|
| 277,628 | 5/1883 | Sullivan | 292/341.16 |
| 322,681 | 7/1885 | Casey | 292/341.16 |
| 1,152,776 | 9/1915 | Wolfe | 292/39 |
| 2,672,745 | 3/1954 | Marchetti | 292/341.15 |
| 3,521,921 | 7/1970 | Miyazaki | 292/201 |
| 3,756,642 | 9/1973 | Fulton | 292/341.15 |
| 3,774,422 | 11/1973 | Hogan et al. | 70/264 |
| 3,933,382 | 1/1976 | Counts et al. | 292/144 |
| 4,073,518 | 2/1978 | Goodwin | 292/144 |
| 4,073,527 | 2/1978 | Schlage | 292/347 |
| 4,161,804 | 7/1979 | D'Hooge et al. | 16/48.5 |
| 4,211,443 | 7/1980 | Butts et al. | 292/341.16 |
| 4,212,489 | 7/1980 | Snyder | 292/33 |
| 4,432,573 | 2/1984 | Goldman | 292/37 |
| 4,606,203 | 8/1986 | Esser | 70/107 |
| 4,679,834 | 7/1987 | Gotanda | 292/169.13 |
| 4,799,719 | 1/1989 | Wood | 292/144 |
| 4,810,014 | 3/1989 | McGourty et al. | 292/144 |
| 4,913,475 | 4/1990 | Bushnell et al. | 292/144 |
| 4,929,003 | 5/1990 | McConnell | 292/144 |
| 4,984,835 | 1/1991 | Vadacchino et al. | 292/341.16 |
| 5,029,912 | 7/1991 | Gotanda | 292/143 |
| 5,035,450 | 7/1991 | Muller | 292/92 |
| 5,076,625 | 12/1991 | Oxley | 292/341.16 |
| 5,083,448 | 1/1992 | Karkkainen et al. | 70/277 |
| 5,100,184 | 3/1992 | Schmitt | 292/144 |
| 5,100,186 | 3/1992 | Nordvall | 292/341.16 |
| 5,199,288 | 4/1993 | Merilainen et al. | 70/279 |
| 5,474,342 | 12/1995 | Smith et al. | 292/254 |
| 5,484,180 | 1/1996 | Helmar | 292/341.16 |

*Primary Examiner*—Darnell M. Boucher
*Assistant Examiner*—John B. Walsh
*Attorney, Agent, or Firm*—Timothy J. Martin; Michael R. Henson

[57] ABSTRACT

A door latch actuator operates a latch bolt assembly of a door. The door latch actuator employs a spring latch plunger and a dead latch plunger mounted in a housing that has a latch cavity sized to receive the spring latch bolt and the dead latch bolt pin. The spring latch plunger engages and retracts under the pressure of the spring latch bolt, and the dead latch plunger engages the dead latch bolt pin. A drive operates the plungers to first withdraw the dead latch plunger to allow the dead latch bolt pin to move to an enabling position for the spring latch bolt. Next, the drive advances the spring latch plunger and thereby the spring latch bolt in moved to a release position and the door may be opened. The drive is preferably a rotary drive using a motor driven crank and pin system. Sensors are provided to detect the position of the system. The method of the invention encompasses the operative steps of this door latch actuator, and the method can include timing steps.

22 Claims, 7 Drawing Sheets

METHOD AND APPARATUS FOR AUTOMATED DOOR LATCH ACTUATOR

FIELD OF THE INVENTION

The present invention generally relates to mechanisms which control access by personnel into and out of buildings or restricted areas. Specifically, this invention relates to an automated door latch actuator that can interface with a standard latch bolt assembly of a door. Thus, this invention can both be original equipment or a retrofit on existing doors. The invention also actuates both spring latch bolt assemblies and dead latch bolt assemblies.

BACKGROUND OF THE INVENTION

This invention is directed to improvements to U.S. Pat. No. 5,474,342 issued Dec. 12, 1995 to Smith et al. In this patent, a door latch actuator is described which is used in association with a conventional latch/bolt or dead latch bolt assembly on a conventional door which is typically mounted on a door frame for movement between a first door position and a second door position. The door latch actuator described in Smith et al includes an actuator element disposed in proximity to the distal end of the latch bolt when the door is at a first door position wherein it is secured. A driver is associated with the actuator element, and the actuator element is movable between a first actuator position and a second actuator position. In the first actuator position, the actuator element allows the distal end of the latch/bolt to engage the latch/bolt receiver when it is extended into a latch bolt cavity in the door jam. In the second actuator position, the actuator element mechanically displaces the latch/bolt from the extended state to the retracted state causing the door to be in an unsecured condition thereby permitting movement of the door. The driver moves the actuator element to accomplish this function.

Where the conventional door latch assembly in the door is of the "dead latch" type consisting of a spring latch bolt with an associated dead latch bolt pin, an alternative door latch actuator according to U.S. Pat. No. 5,474,342 has an actuator element disposed in proximity to the distal ends of both the spring latch bolt and the dead latch bolt pin. The driver moves the actuator element between the first and second actuator positions. When in the first actuator position, the actuator element is operative to retain the dead latch bolt pin in a disabled (retracted) state while allowing the spring latch bolt to extend in the latch/bolt receiving cavity. The actuator element, when moved from the first actuator position to the second actuator position, first releases the dead latch bolt pin which moves into the enabled (extended) state and afterward attacks the distal end of the spring latch bolt to move the spring latch bolt from the extended state to the retracted state.

In U.S. Pat. No. 5,474,342, several embodiments of the door latch actuator are disclosed. In one embodiment, the actuator element is a cam which is configured to have two cam lobes respectively controlling the dead latch bolt pin and the spring latch bolt. Two independent cam elements are disclosed for construction of the actuator element, and the use of two independently acting solenoids is taught in this patent. Alteratively, an articulated actuator element is described, among other embodiments.

While the door latch actuator described in U.S. Pat. No. 5,474,342 represents a significant advance over the art of automated security latch systems, further development of an automated system has revealed additional challenges where two independent plungers are used to control the spring latch bolt and the dead latch bolt pin of the door latch assembly. Whereas the above referenced patent contemplated driving two independent plungers with two separate solenoids, it is more desirable to utilize a single motor to obtain greater force for a reasonable amount of electrical power consumption. Moreover, the use of an electrical motor achieved a more compact design necessary to permit concealed installation in typical door frames.

In addition, the Smith et al patent did not completely address a situation where a secured door might be prestressed prior to attempted release. It can be anticipated that, in many cases, pressure will exist on the door latch in the door opening direction at the time that the door latch actuator is operated. This pressure can come from a poorly aligned door or from an impatient person already trying to push or pull the door open before the door latch actuator has had a chance to operate. The Smith et al patent addresses such a problem by utilizing sufficient mechanical force in pushing in the latch. However, the generation of such a brute force can make the construction of the actuator cumbersome so that it does not readily fit into a door frame. Alternatively, the actuator can operate slower thus trading time for force to increase the amount of actuating force but slower operation of the door latch actuator is in itself a disadvantage.

There is, however, an entirely separate problem to merely applying such sufficient force to operate the actuator system. Because of the way in which deadlatch assemblies are manufactured, when the door is in the secured condition (that is, with the latch/bolt released into the strike hole and the dead latch bolt pin pushed in), pressure on the spring latch/bolt in the door opening direction can often bind the dead latch bolt pin so that it will not come out of the disable position. Mechanized pushing on the spring latch/bolt to release the door will only serve to increase the binding force on the unit if the dead latch bolt pin has not first successfully "popped" into the enable state.

Accordingly, it may be appreciated that a need exists for automated door latch actuator devices. There is a further need for such door latch actuator devices that can improve on the construction of existing automated systems. There is a further need for providing an automated door latch actuator which anticipates and addresses door stressed conditions. There is also a need for improved methods of controlling automated door actuating systems. The present invention is directed to resolving these needs.

SUMMARY OF THE INVENTION

It is an object of the present invention to provide a new and useful method and apparatus for automated door latch actuating which can be implemented with existing spring latch assemblies on existing door securing systems.

Another object of the present invention is to provide an automated door latch actuator which can be mounted into existing door frames for interfacing with existing door latch assemblies.

A further object of the present invention is to provide a door latch actuator of simplified construction that is compact and which uses a minimum of parts.

Still a further object of the present invention is to provide a door latch actuator which is relatively inexpensive in manufacture yet reliable in use.

It is another object of the present invention to provide a door latch actuator which operates reliably in a door prestress condition.

Yet another object of the present invention is to provide a door latch actuator and method with the capabilty of sensing the secure or released state of the door latch assembly for automated monitoring and control. According to the present invention, then, a door latch actuator is adapted to engage a door latch assembly on a door to retain the door in a fastened state. Such door latch assembly includes in one embodiment called a "dead latch", a spring latch bolt reciprocally moveable between an engaged position such that it can engage the door latch actuator and a release position wherein the door is released from the fastened state. This dead latch assembly also includes a dead latch bolt pin that reciprocally moves between an enable position (extended) that permits movement of the spring latch bolt from the engaged position to the release position and a disable position (retracted) which prohibits movement of the spring latch bolt from the engaged position to the release position. The spring latch bolt and the dead latch bolt pin are both resiliently biased into the engaged position and the enable position, respectively.

According to the present invention, the door latch actuator includes a housing that has a forwardly opening latch cavity formed therein that is sized and adapted to receive the spring latch bolt and the dead latch bolt pin when the door is in the fastened state. A spring latch plunger is mounted for reciprocal movement in the housing between an extended position and a retracted position. The spring latch plunger includes a portion disposed in the latch cavity that is operative to engage the spring latch bolt when the door is in the fastened state and to be biased thereby into the retracted position. A dead latch plunger is mounted for reciprocal movement in the housing between an advanced position and a withdrawn position. The dead latch plunger includes a portion disposed in the latch cavity that is operative to engage the dead latch bolt pin when in the fastened state. A rotary drive is provided in the housing and the rotary drive includes a crank that is operative to reciprocally drive the dead latch plunger between the advanced and withdrawn positions during a rotary cycle thereof. The rotary drive is also operative to positively advance the spring latch plunger from the retracted position to the extended position during a portion of the rotary cycle.

In its more detailed form, the present invention includes a strike plate that is disposed on the housing and which has an opening that is registered with the latch cavity to define a mouth for the latch cavity. The spring latch plunger terminates in a front face that is in contact with the spring latch when the door is in the fastened state, and this front face is coextensive with the opening in the strike plate when extended. The dead latch plunger terminates in a front surface that contacts the dead latch bolt pin when the door is in the fastened state, and this front surface is coextensive with the opening in the strike plate when in the advanced position. The dead latch plunger also has a side surface that is operative to abut the spring latch bolt when both the dead latch plunger is in the advanced position and when the spring latch plunger is in the retracted position thereby to retain the door in the fastened state. The thickness of the dead latch plunger is preferably greater than the thickness of the dead latch bolt pin.

During operation, the rotary drive preferably first drives the dead latch plunger from the advanced position to the withdrawn position and next drives the spring latch plunger from the retracted position to the extended position. The rotary drive preferably operates continuously to drive the dead latch plunger during the rotary cycle. For example, the rotary drive may be a rotatable crank that includes a drive pin radially offset from the crank axis, but parallel thereto. Each of the spring latch plunger and the dead latch plunger are provided with slotted openings which receive the drive pin with these slotted openings being configured such that the dead latch plunger is driven from the advanced position to the withdrawn position during a first portion of the drive cycle and wherein the spring latch plunger is driven from the retracted position to the extended position during a second portion of the drive cycle. The front face of the spring latch plunger and the front surface of the dead latch plunger, may generally be co-planar and oriented at a small acute angle to a plane that is perpendicular to the throw direction of the spring latch plunger. Moreover, where the dead latch bolt pin has a length, a width and a thickness of a selected dimension, it is desired that both the front face of the spring latch plunger and the front surface of the dead latch plunger be provided with a channel that is wider than the width of the dead latch bolt. The dead latch plunger has a lip disposed adjacent to its front surface and facing the spring latch plunger, and the spring latch plunger has a shoulder sized and configured to engage this lip.

The housing may be constructed to include a chamber that has parallel top and bottom walls and parallel side walls. The spring latch plunger and the dead latch plunger may each then be formed as rectangular blocks nested in the chamber for guided movement thereby with this chamber communicating with the latch cavity. The spring latch plunger may include a recess sized and adapted to receive the rotary crank, and the rotary crank is then disposed in the recess of the spring latch plunger for rotational movement about the rotation axis. The rotary drive motor may include a worm gear drive to turn the rotary crank, and rotation sensors are provided for detecting the rotational position of the crank during the rotary cycle thereof. Throw sensors may also be provided for detecting the position of the spring latch plunger.

According to the method of the present invention, the spring latch bolt and the dead latch bolt pin of the latch assembly described above are received in an actuator that is provided with a spring latch plunger which engages the spring latch bolt and with a dead latch plunger which engages the dead latch bolt in such a manner that the spring latch bolt is allowed to move into the engaged position and the dead latch bolt is held in the disabled position.

The dead latch plunger is mechanically driven from an advanced position to a withdrawn position during a first interval of time so that the dead latch bolt pin may move from the disabled position to the enabled position to define an intermediate state. Next, the spring latch plunger is mechanically driven over a second interval of time from the retracted position to the extended position so as to move the spring latch bolt from the engaged position to the release position to define the released state. The first and second intervals together define a drive interval, and it is desired that the dead latch plunger be driven from the withdrawn position back to the advanced position. The method then includes the step of holding the spring latch plunger in the extended position for a third or "dwell interval" of time after which the actuator is returned to the initial state during a fourth interval of time.

The method according to this invention, includes the step of monitoring the spring latch plunger to determine if it is in the extended position or the retracted position. Here, the method may include the step of preventing the mechanical driving of the dead latch plunger at the start of the first interval of time if the spring latch plunger is not in the retracted position. The method may also include the step of preventing the actuator from returning to the initial state if the spring latch plunger is not in the extended position after the third or dwell interval of time. In the preferred method, it is desired that the first and second interval of times, which define the drive interval of time, be approximately 300 milliseconds. The third or dwell interval of time depends upon the time the trigger is engaged. During that time the door latch actuator actively releases the door.

These and other objects of the present invention will become more readily appreciated and understood from a consideration of the following detailed description of the exemplary embodiment when taken together with the accompanying drawings, in which:

DETAILED DESCRIPTION OF THE EXEMPLARY EMBODIMENTS

The present invention is broadly directed to an automated door latch actuator system that is adapted to be installed in the door jam so that it can operate with a conventional door latch assembly of a common door. This invention also encompasses a method for automated door actuation.

The present invention is particularly adapted for use with security doors that can be electronically activated to release the door so that it may be moved from a secured first door position wherein it is secured within the door jam to an open position. The door latch actuator is primarily adapted for use with a dead latch assembly mounted in the door wherein the dead latch assembly includes both a spring latch bolt and a dead latch bolt pin. The present invention without modification also, however, successfully operates a spring latch assembly that does not include a dead latch. Moreover, the present automated door latch actuator is adapted to be mounted within the dimensions of commonly employed door jams in use for normal building construction.

Figure 1:
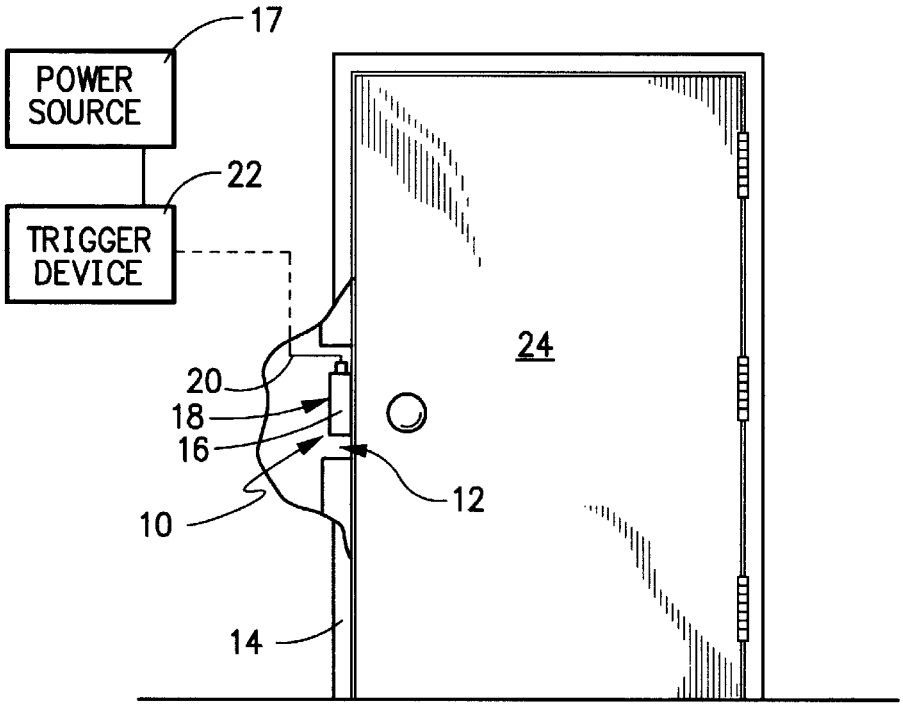
FIG. 1 is a side elevational view of a door in a secured condition at a first door position within a door jam and having a portion of the door jam broken away to show a door latch actuator according to the exemplary embodiment of the present invention and operable with a conventional latch bolt assembly of the door.
Figure 2:
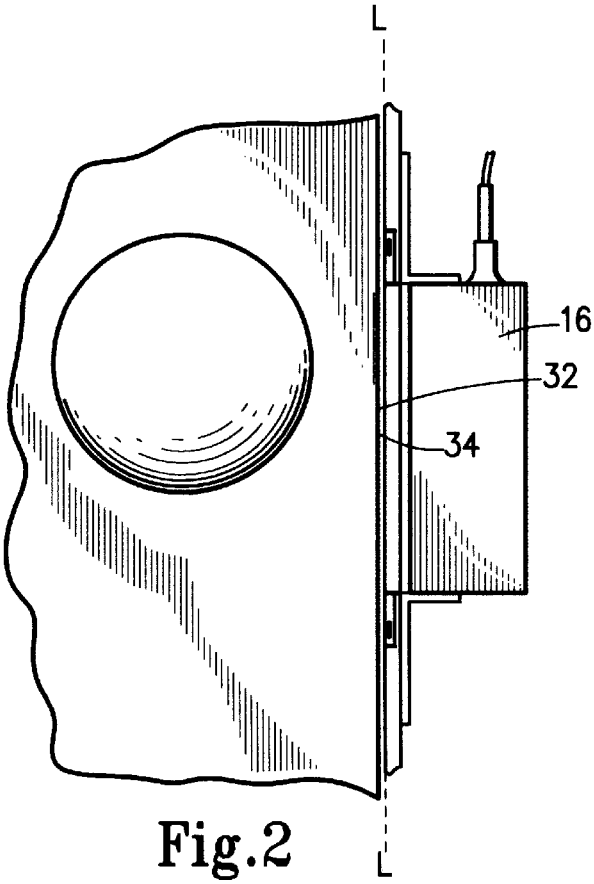
FIG. 2 is a side view in elevation, partially broken away, showing the door latch actuator of the present invention securing a door in the first door position.

With reference, then, to FIG. 1, the exemplary embodiment of the present invention is in the form of an automated door latch actuator 10 that is received in a cavity 12 in a typical door jam 14. Actuator 10 includes an outer housing 16 which mounts its mechanical and electronic components. The electrical components in turn are electrically in communication with a controller 18 by means of wiring 20. Controller 18, for example, may be electrically in communication with a source 17 of electrical power (typically 12 or 24 volts) and with a trigger device 22 such as activation of the trigger device will cause the door latch actuator to activate. The trigger device 22 may typically be a switch whose contacts transfer to activate the door latch actuator. The trigger device 22 however is often incorporated into a controlled entry device such as a card reader or digital entry keypad. When an authorized card is presented or when an authorized code is composed, the integral switch transfers is contacts to actuate the door latch actuator.

Figure 3:
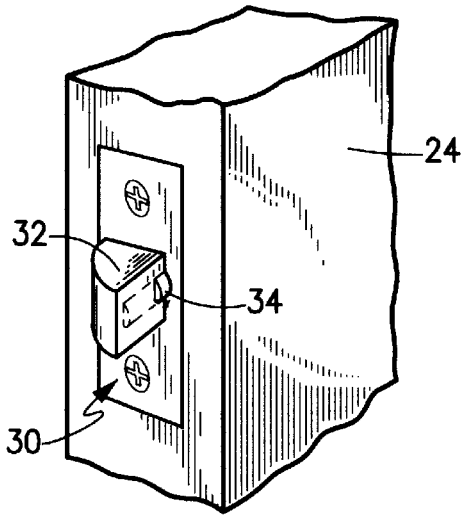
Fig.3 (PRIOR ART)
FIG. 3 is a perspective view of a distal ends of a conventional latch bolt assembly of the dead latch type including a spring latch bolt and a dead latch bolt pin which extend therefrom and which is installed in a conventional door according to the prior art.

A typical door 24 is shown in FIG. 1 in a first or closed position. Again for example purposes, door 24 may be pivotally mounted so that it can move between the closed position and an open position. Door latch actuator 10 is constructed to interface with a standard latch bolt assembly 30 according to the prior art, as is best shown in FIG. 3. Here, it may be seen that latch bolt assembly 30 includes a spring latch bolt 32 and a dead latch bolt pin 34. Both spring latch bolt 32 and dead latch bolt pin 34 are spring biased to extend into a latch bolt receiving cavity in the door jam 14 when the door 24 is in the first or closed position. As one of ordinarily skill in the art should appreciate, spring latch bolt 32 is slideably movable between an advanced or "engage position" such that it can engage the latch bolt receiving cavity and a retracted or "release position" wherein the latch assembly becomes disengaged allowing the door to open.

The dead latch bolt pin is reciprocally movable between an advanced or "enable position" and a retracted or "disable position". As is known to those in the art, when the dead latch bolt pin is in the disable position, it prevents movement of the spring latch bolt. However, when the dead latch bolt pin moves into the enable position, the spring latch bolt may reciprocate between the engaged position and the released position. In FIG. 3, dead latch bolt pin 34 is shown in the disable position but is shown, in phantom, in the enable position. Spring latch bolt 32, on the other hand, is shown in the engage position. It should be understood, though, that the present invention can be used to operate doors that have latch bolt assemblies that do not have a dead latch bolt pin but rather provide only the spring latch bolt. No modification is required for such operation. For sake of illustration, the exemplary embodiment is described in conjunction with latch bolt assembly 30 which has a dead latch assembly.

The assembly of spring latch actuator 10 is best shown in FIGS. 2, 4–8 and 10(*a*)–10(*c*). In these figures, it may be seen that housing 16 includes a strike plate 40 disposed thereon with an opening 38 that registers with a latch cavity 36 that is operative to receive the spring latch bolt and the latch bolt bolt pin of dead latch assembly 30. Latch cavity 36 communicates with a chamber 42 in housing 16 that is formed by a top wall 44, a bottom wall 46 that is parallel to top wall 44 and parallel side walls 48 and 49. A spring latch plunger 52 and a dead latch plunger 54 are disposed in chamber 42 for reciprocal movement therein. Each of spring latch plunger 52 and dead latch plunger 54 reciprocate in a throw direction that is parallel to the direction of throw of each of spring latch bolt 32 and dead latch bolt pin 34 and perpendicular to latch plane "L".

Figure 8:
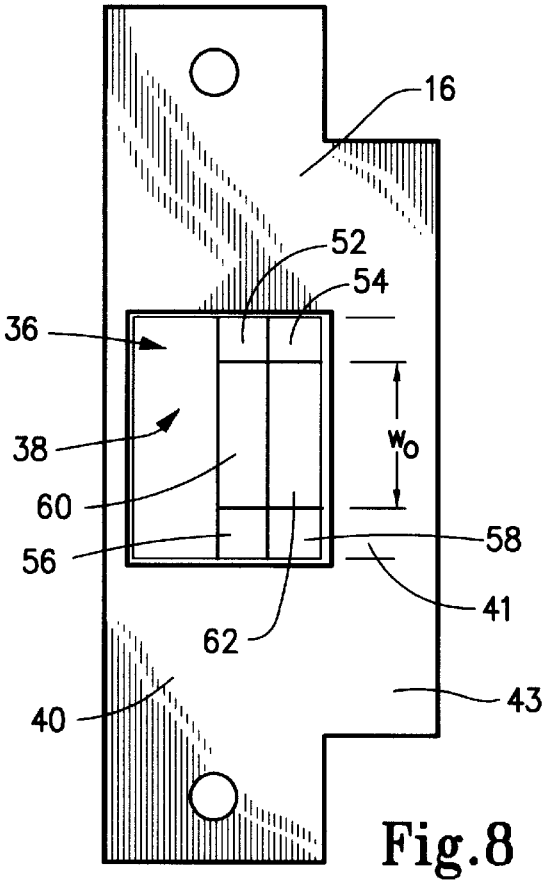
FIG. 8 is a front view in elevation of the door latch actuator of FIGS. 5–7.
Figure 9:
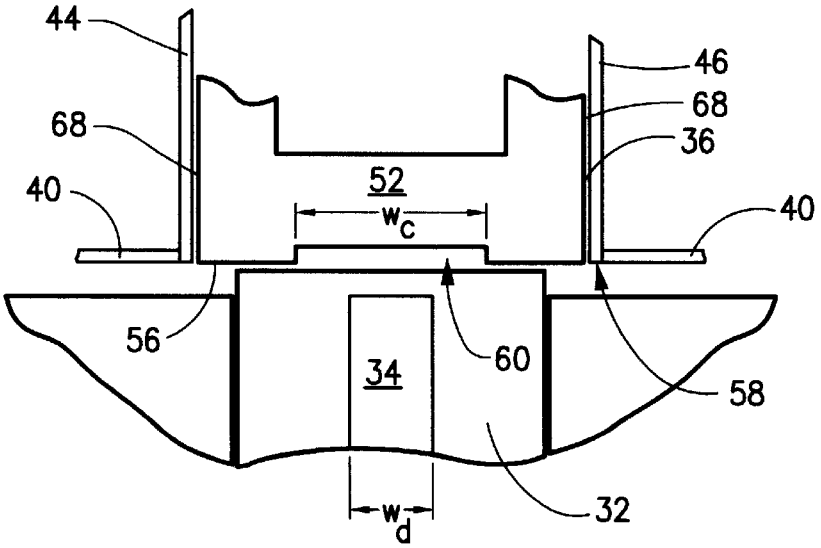
FIG. 9 is an enlarged front view in elevation and partial cross-section showing the engagement of the spring latch bolt with the spring latch plunger according to the present invention.

As is shown in FIG. 8, spring latch plunger 52 has a front portion including a front face 56 that contacts spring latch bolt 32 when spring latch bolt 32 is received in cavity 36. Dead latch plunger 54 has a front portion including a front surface 58 that contacts dead latch bolt pin 34. Co-extensive channels 60 and 62 are respectively formed in front face 56 and front surface 58 with channels 60 having a width "$w_c$" that is greater than the width "$w_d$" of dead latch bolt pin 34. Spring latch bolt 52 also has a shoulder 64 formed adjacent from front face 56 that is sized to register and to mate with a lip 66 formed adjacent front surface 58 of dead latch plunger 54.

Figure 4:
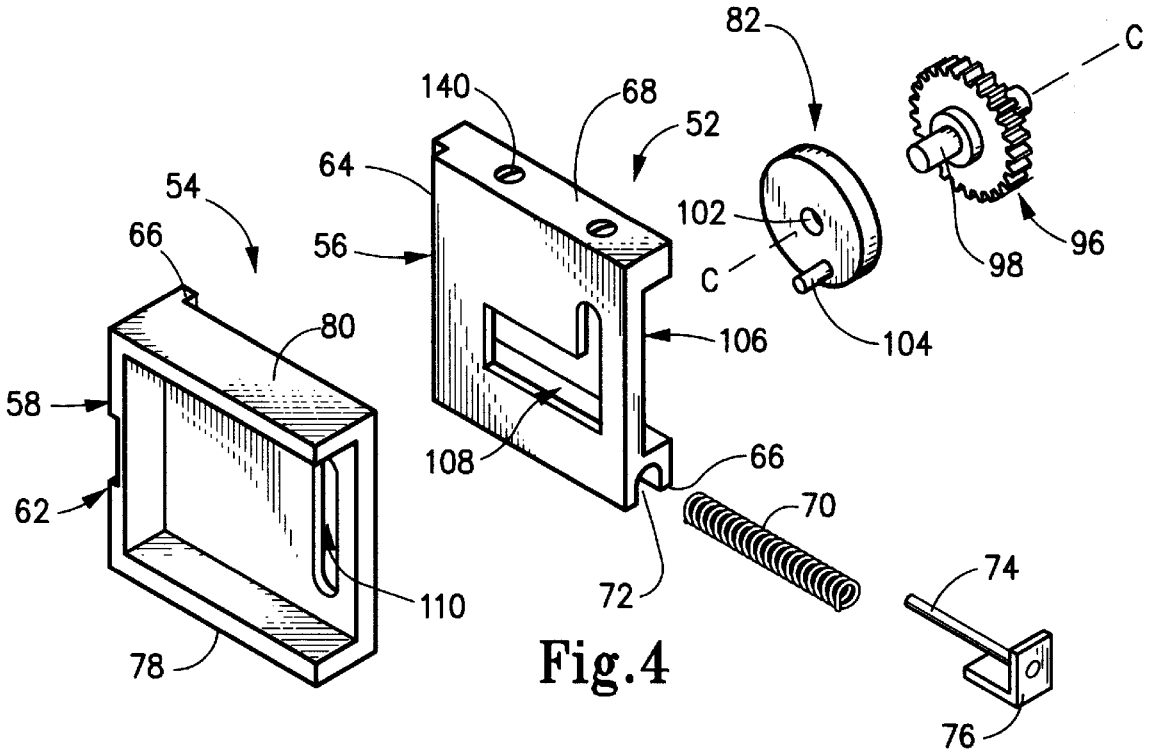
FIG. 4 is an exploded view in perspective showing the spring latch plunger, dead latch plunger and rotary crank according to the exemplary embodiment of the present invention.
Figure 5:
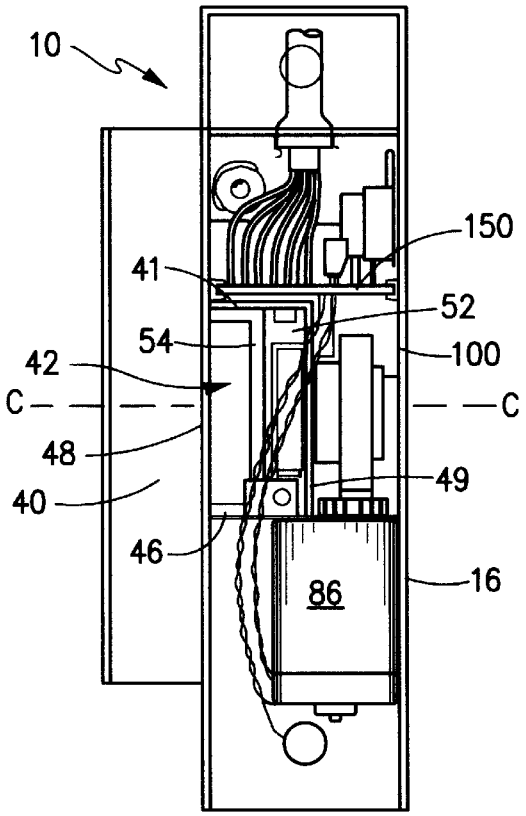
FIG. 5 is a rear view in elevation showing the door latch actuator according to the exemplary embodiment of the present invention.
Figure 6:
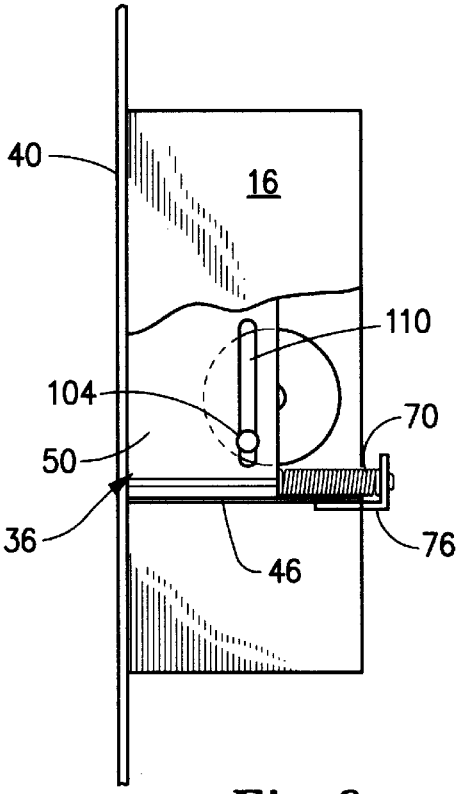
FIG. 6 is a left side view in elevation, partially broken away, showing the door latch actuator of FIG. 5.

As is shown in FIGS. 4–6, the spring latch plunger 52 is formed as a rectangular block having a pair of lateral side surfaces 66 and 68 which are spaced apart from one another so that spring latch plunger 52 is sized for close-fitted insertion between top and bottom walls 44 and 46 of chamber 42. Thus, spring latch plunger 52 is supported for guided movement in chamber 42. A biasing spring 70 is received in a groove 72 formed in side surface 66 of spring latch plunger 52, and spring 70 is held positioned in groove 72 by a rod 74 mounted by a support bracket 76 affixed to bottom wall 46. Accordingly, spring latch plunger 52 is biased into the extended position. The force provided by spring 70, however, is less than the force that biases spring latch bolt 32 into the engage position. Therefore, the force of spring latch bolt 32 will overcome the biasing of spring latch plunger 52 so as to cause spring latch plunger 52 to move into the retracted position when spring latch bolt 32 is received in cavity 36.

Dead latch plunger 54 is also configured as a rectangular block that is nested in chamber 42 for guided movement thereby. To this end, dead latch plunger 54 has a pair of lateral side surfaces 78 and 80 which are parallel to and opposite one another and are spaced apart so that dead latch plunger 54 is sized for close-fitted insertion between top wall 44 and bottom wall 46 of chamber 42. Dead latch plunger 54 has a thickness "$t_b$", and spring latch plunger 52 has a thickness "$t_a$". With reference to FIG. 5, it may be seen that the combined thicknesses "$t_a$" plus "$t_b$" are selected so that spring latch plunger 52 and dead latch plunger 54 are in close-fitted, slideably mated engagement in chamber 42 between side walls 48. Moreover, it may be appreciated in reference to FIG. 10(*a*), for example, that the thickness "$t_b$" of dead latch plunger 54 is substantially greater than the thickness "$t_d$" of the dead latch bolt pin 34.

Figure 7:
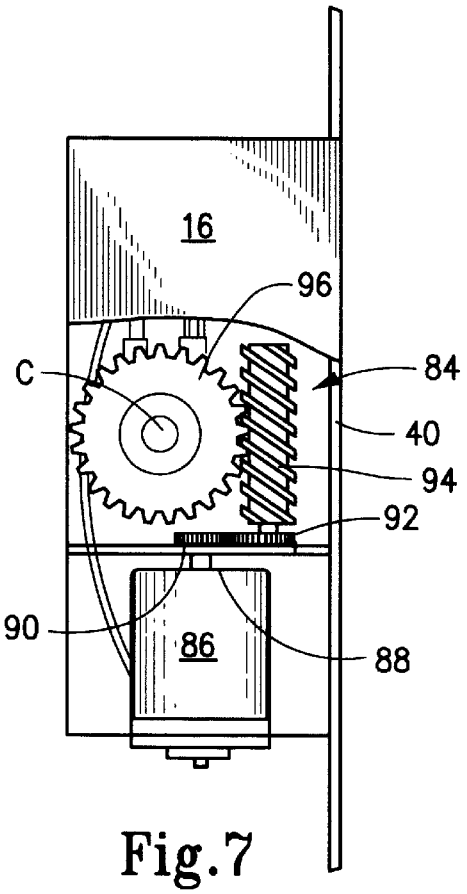
FIG. 7 is a right side view in elevation, partially broken away, showing the door latch actuator of FIGS. 5 and 6.

As noted, spring latch bolt 52 is mounted for reciprocal movement between the extended position and a retracted position. Similarly, dead latch plunger 54 is moveable between an advanced position and a withdrawn position. In order to control this movement, a drive is provided which preferably is a rotary drive that includes a crank 82 that is rotatably driven through a gear drive train 84 by means of a motor 86. As is shown in FIGS. 4, 5 and 7, motor 86 has a drive shaft 88 that connects to a first drive gear 90 that engages a second drive gear 92 which is rigidly mounted on a common shaft with worm gear 94. Worm gear 94 is journaled for common rotation with drive gear 92 and, upon rotation, engagably drives a primary drive gear 96 mounted on a shaft 98 that is journaled in suitable bearings (not shown) between a side wall 49 of chamber 42 and side wall 100 of housing 16.

Crank 82 is rigidly affixed to shaft 98 and is disposed on a side of wall opposite primary drive gear 96. Crank 82 is in the form of an annular disk having a central bore 102 that receives shaft 98 so that crank 82 is connected thereto by any convenient manner, such as keying, a set screw or the like. Thus, shaft 98 defines a crank axis "C" that is perpendicular to the throw direction. Crank 82 includes a drive pin 104 that is parallel to the crank axis "C" but which is radially offset therefrom. Crank 82 is sized to be nestably received in a recess channel 106 formed in the surface of spring latch plunger 52 which faces crank 82.

Each of the plungers are provided with a slotted configuration so that they may be reciprocally driven by crank 82. To this end, spring latch plunger 52 includes an L-shaped slotted opening 108 through which drive pin 104 extends. Drive pin 104 has a sufficient length so that it also extends through a linear slotted opening 110 formed through dead latch plunger 54.

Figure 10A:
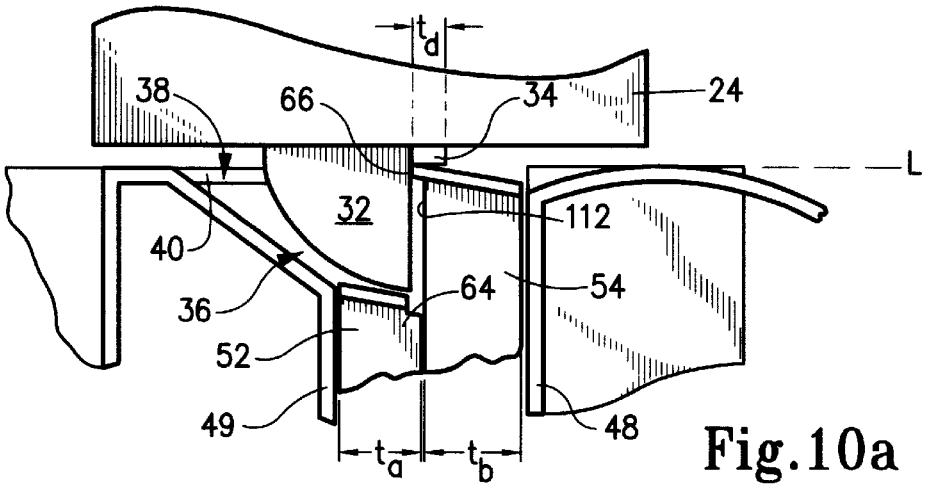
FIGS. 10(*a*), 10(*b*) and 10(*c*) are top views in cross-section showing the spring latch plunger, dead latch plunger, spring latch bolt and dead latch bolt pin positions during a rotary cycle of the door latch actuator according to the present invention.
Figure 10B:
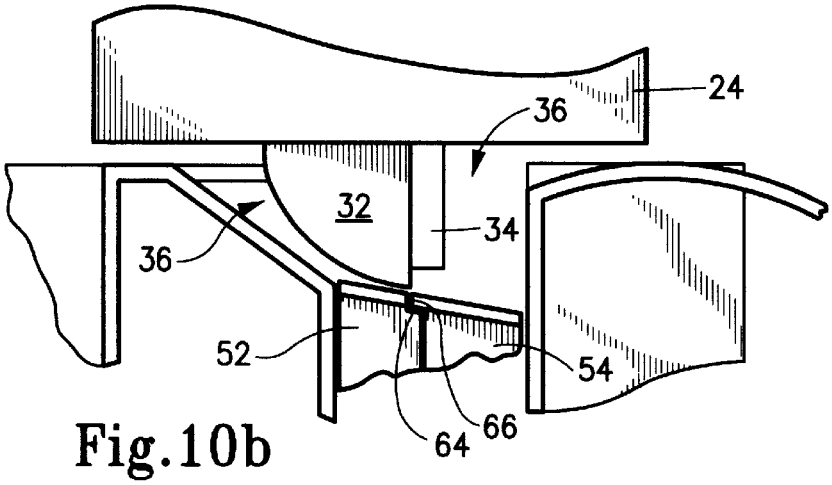
Figure 10C:
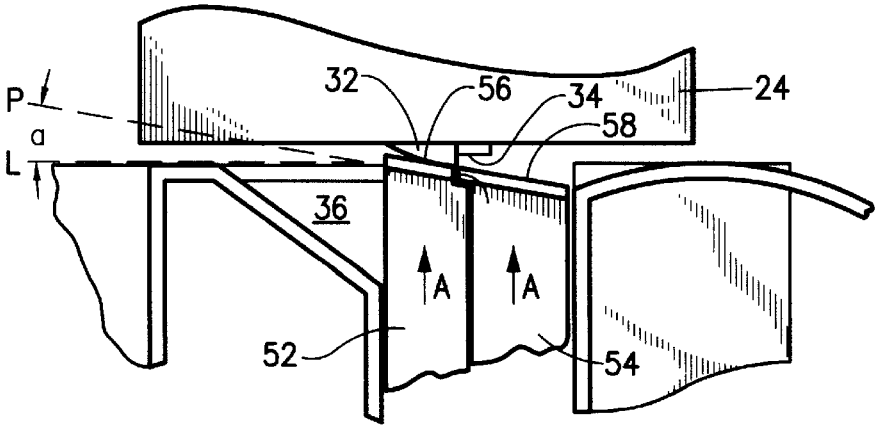
Figure 11A:
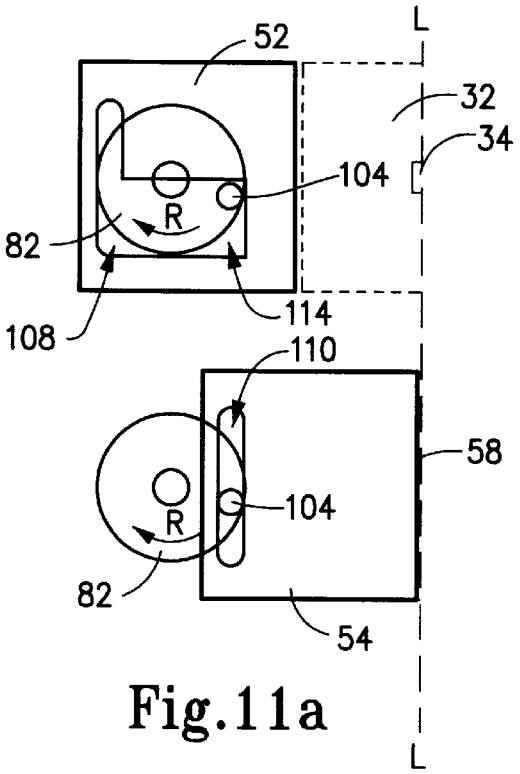
FIGS. 11(*a*), 11(*b*) and 11(*c*) are diagrammatic views showing the locations of the spring latch plunger and the dead latch plunger during a rotary cycle of the drive assembly according to the present invention.
Figure 11B:
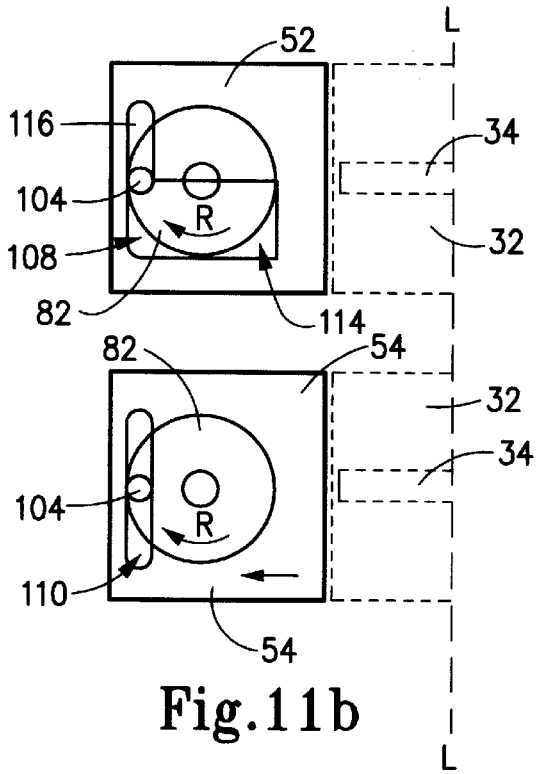
Figure 11C:
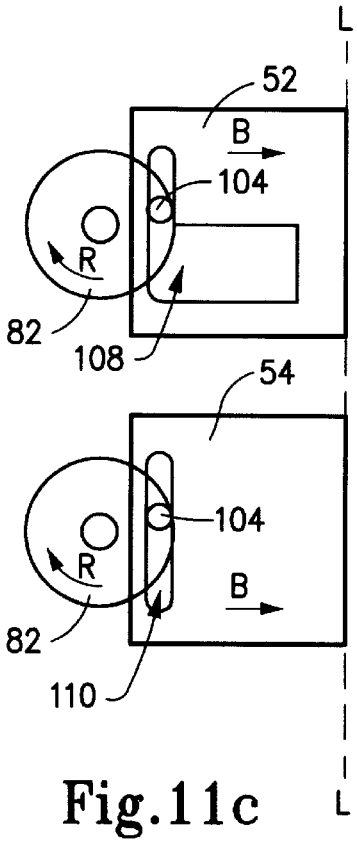

The operation of door latch actuator 10 can now be more fully appreciated with references to FIGS. 10(*a*)–10(*c*) and FIGS. 11(*a*)–11(*c*). In FIG. 10(*a*), it may be seen that spring latch bolt 32 is received in cavity 36 through opening 38 in strike plate 40. The biasing force of spring latch bolt 32 is shown to overcome the force of spring so that spring latch bolt 32 is moved into the engaged position while spring latch plunger 52 has moved into the retracted position. Dead latch bolt pin 34, however, is in the disabled position because dead latch plunger 54 is in the advanced position in this figure.

During a rotary cycle of crank 82, however, the arrangement shown in FIG. 10(*a*) changes to that shown first in FIG. 10(*b*) and next to that shown in FIG. 10(*c*). As is shown in FIG. 10(*b*), crank 82 has moved dead latch plunger 54 into the withdrawn position allowing dead latch bolt pin 34 to move into the enable position where it is fully extended from door 24. Thus, dead latch bolt pin 34 extends into cavity 36. At this point, spring latch bolt 32 becomes enabled for movement toward the release position. It should be noted at this point also, that, due to the thickness of dead latch plunger 54 relative to the thickness of dead latch bolt pin 34, dead latch bolt pin 34 may freely move which substantially eliminates the possibilities of binding. This is because spring latch plunger 32, when in the engaged position, confronts a side surface 112 of dead latch plunger 54 with dead latch plunger 54 being thicker than the dead latch bolt pin. This construction prevents contact between dead latch bolt pin 34 and side wall 48 that forms cavity 36. The specific type of binding prevented by this design feature can occur when the spring latch bolt is stressed by pressure being put on the door in the door opening direction. The rear projection of the spring latch bolt in a standard dead latch type door latch assembly is in close proximity to the rear projection of the dead latch bolt pin. The stress on the spring latch bolt can thereby prevent the dead latch bolt pin from moving to its enable position. However, when the dead latch plunger retracts, all stress is momentarily released on the spring latch bolt and the dead latch bolt pin is free to "pop" out.

After reaching the states shown in FIG. 10(*b*), crank 82 next concurrently drives spring latch plunger 52 and dead latch plunger 54 in the direction of arrows "A" so that spring latch plunger 52 moves from the retracted position shown in FIGS. 10(*a*) and 10(*b*) to the extended position shown in FIG. 10(*c*). Correspondingly, dead latch plunger 54 returns from the withdrawn position shown in FIG. 10(*b*) to the advanced position shown in FIGS. 10(*c*) and 10(*a*). During this movement, the forward portion of spring latch plunger 52 that engages spring latch bolt 32 forces spring latch bolt 32 into the released position shown in FIG. 10(*c*).

It may also be noted best with respect to FIG. 10(*c*) that front face 56 of spring latch plunger 52 and front surface 58 of dead latch plunger are generally co-planar with one another in plane "P". However, plane "P" is oriented at a small acute angle "a" all with respect to latch plane "L". Angle "a" may, for example, be in a range of about 5°–15°. Latch plane "L" should be understood as the plane that defines when spring latch bolt 32 will engage or release door latch actuator 10. Angle "a" helps insure that, as the spring latch and dead latch plungers move together so as to release the dead latch assembly, they contact the spring latch bolt before they contact the dead latch bolt pin thus avoiding the possibility of jamming that otherwise might occur if the dead latch bolt pin were contacted first. In addition to this small acute angle of the spring latch plunger and dead latch plunger surfaces with respect to the plane of the strike plate together, the channels 60, 62 cut in these two surfaces serve to insure that the spring latch/bolt is always contacted and moved by the shoulders of the spring latch plunger prior to the dead latch bolt pin being contacted and moved by the center of the channel in the dead latch plunger despite any poor alignment of the door latch assembly. Also, as is known in the art, flange 43 of the strike plate 40 facilitates engagement of latch bolt assembly 30 with door latch actuator 10 by moving spring latch bolt 32 an thus dead latch bolt pin 34 into the release and disable positions, respectively, when door 24 is closing.

The rotary cycle of the movement of spring latch plunger 52 and dead latch plunger 54 is diagrammed in FIGS. 11(*a*)–11(*c*). In each of these figures, latch plane "L" is shown and it should be understood that this latch plane "L" is generally co-extensive with the strike plate 40. In these figures, then, the relative position of each of the plungers and the associated drive pin 104 of crank 82 in slots 108 and 110, is respectively depicted. In FIG. 11(*a*), it may be seen that dead latch plunger 54 is in the advanced position wherein front surface 58 is co-extensive with latch plane "L". Due to the positioning of drive pin 104 in the large rectangular region 114 of L-shaped slot 108, however, spring latch bolt 32 (shown in phantom) extends beyond the latch plane so as to be in the engaged position. Dead latch bolt pin 34 (shown in phantom) is held in the disabled position by dead latch plunger 54 while spring latch bolt 32 would be in the engage position. As crank 82 is driven in the direction of arrow "R", spring latch bolt 32 stays in position. This corresponds to the configuration of FIG. 10(*a*).

As crank arm 82 is driven in the direction of arrow "R", drive pin 104 causes dead latch plunger 54 to move into the withdrawn position, as is shown in FIG. 11(*b*), so that spring latch bolt 32 remains in the engage position while dead latch bolt pin 34 moves into the enable position. As this happens, drive pin 104 begins to move into the smaller slotted leg 116 of L-shaped slot 108. This position also corresponds to FIG. 10(*b*). Further rotation in the direction of arrow "R" now causes spring latch plunger 52 to move into the extended position and, contemporaneously, dead latch plunger 54 to move into the advanced position in the direction of arrows "B" shown in FIG. 11(*c*). This, then, corresponds to the release position for spring latch bolt 32 so that the door is released. This position also corresponds to FIG. 10(*c*), discussed above. It should finally be appreciated that a further slight angular advancement of crank 82 in the direction of arrow "R" returns the door latch actuator to the state shown in FIG. 11(*a*). However, it should be here understood that spring latch plunger 52 will remain in the extended position, due to the resilient biasing of spring 70, until the door again is moved into the closed position so that the biasing force of spring 70 is overcome by the spring latch bolt 32.

Figure 12:
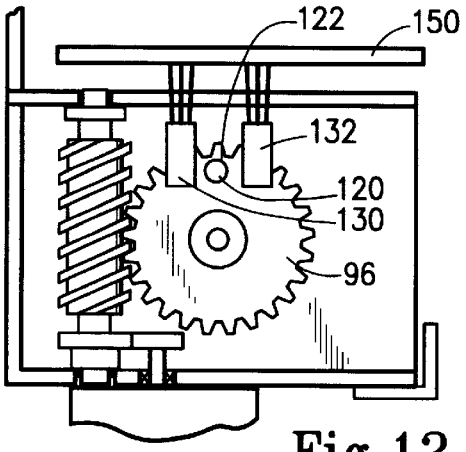
FIG. 12 is a side view in cross-section showing the motor and worm gear drive of the door latch actuator according to the present invention and further showing the rotational position sensors for implementing the method of the present invention.
Figure 13:
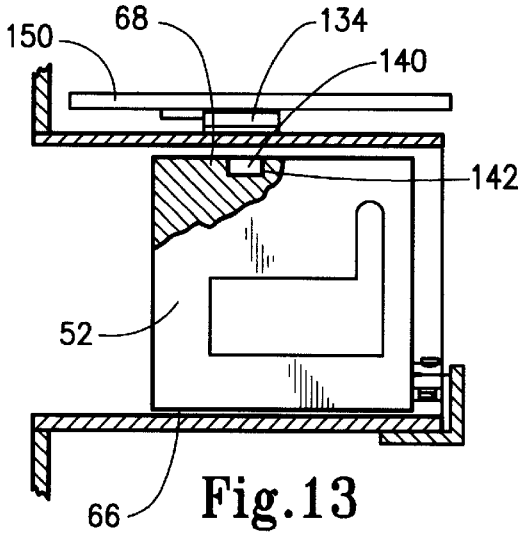
FIG. 13 is a side view in cross-section and partially broken away showing the spring latch plunger of the present invention in the retracted position along with the plunger positioning sensor for implementing the method of the present invention.

From this description, it should be appreciated that it is helpful to monitor both the position of rotary crank 82 for the beginning and end of the rotary cycle. It is also helpful to monitor the position of spring latch plunger 52 to know whether it is in the extended or retracted position. Such monitoring and control implements the method of this invention. As shown, then, in FIGS. 12 and 13, electrical sensors are provided to accomplish this task. In FIG. 12, it may be seen that primary drive gear 96 has a small permanent magnet 120 affixed in a bore 122 formed in a margin of gear 96. A pair of Hall effect devices 130 and 132 are affixed to a circuit board 150 and are oriented approximately 20° of rotation from one another with respect to gear 96 so that magnet 120 will pass in close proximity thereto. The proximity of magnet 120 to Hall effect devices 130 and 132, respectively, produce a position signal. Since gear 96 is rigidly affixed to crank 82, this signal is produced by Hall effect devices 130 and 132 as magnet 120 passes thereby will indicate the position of drive pin 104 and thus the position of dead latch plunger 54.

In order to monitor the position of spring latch 52, a small permanent magnet 140 is mounted in a bore 142 in surface 68 thereof. A third Hall effect device 134 is positioned such that magnet 140 will be proximate to Hall effect device 134 when spring latch plunger 52 is in the retracted position. When spring latch plunger 52 is in the extended position, no such signal is present so that Hall effect device 134 thus monitors whether spring latch plunger 52 is in the extended position or the retracted position.

The microprocessor equipped controlling circuit board 150 defines controller 18 and monitors the signals from Hall effect devices 130, 132 and 134 to monitor the positioning of the door latch actuator 10 and also initiates the rotary cycle of crank 82 when a trigger signal from trigger element 22 is generated to unsecure the door 24. This circuitry is contained within housing 16 and mounted on the circuit board 150, as is shown in FIG. 5. The controller flow diagram is depicted in FIG. 14 while the circuit diagram for this controller is shown in FIG. 15.

Figure 14:
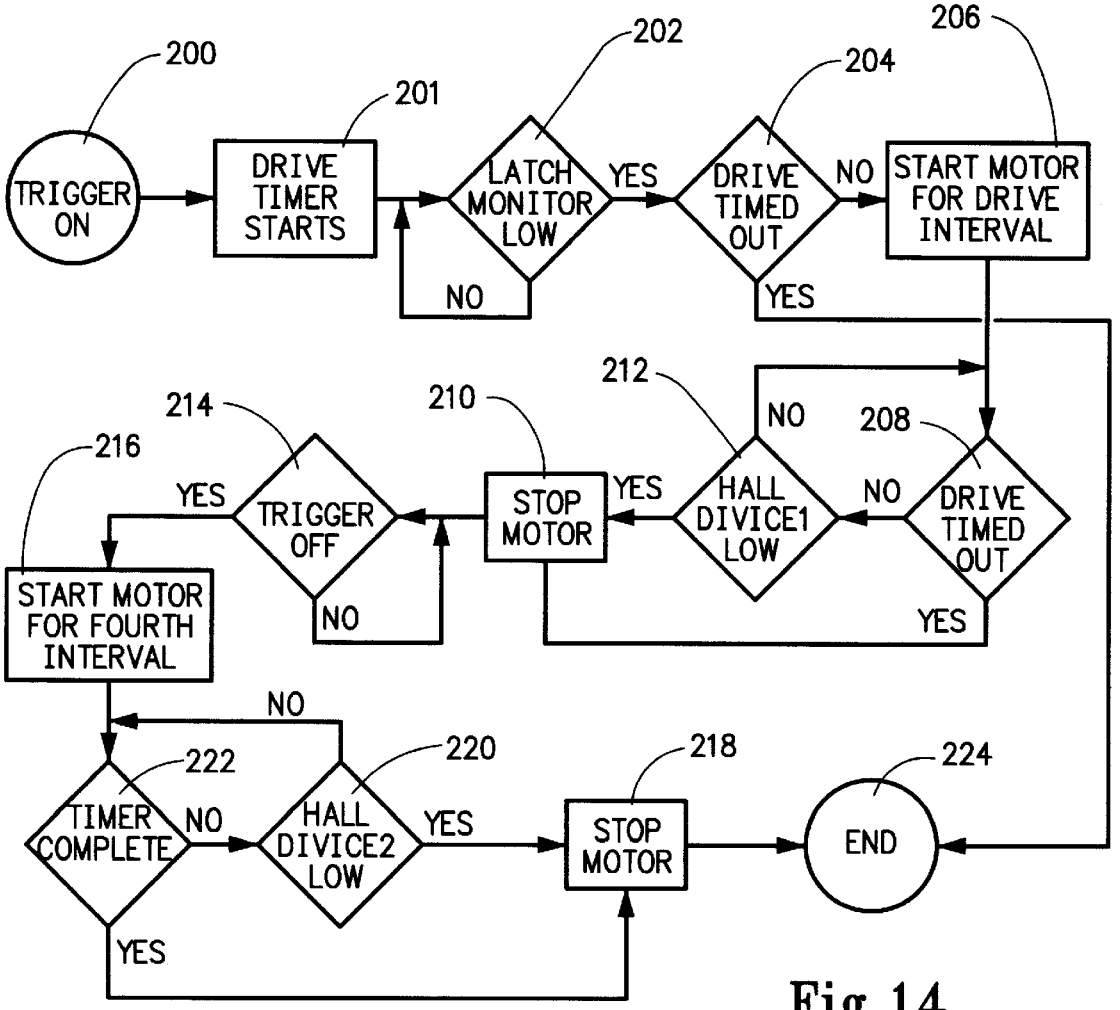
FIG. 14 is a flow chart showing the operation of the door latch actuator according to the present invention and method.
Figures 15A, 15B:
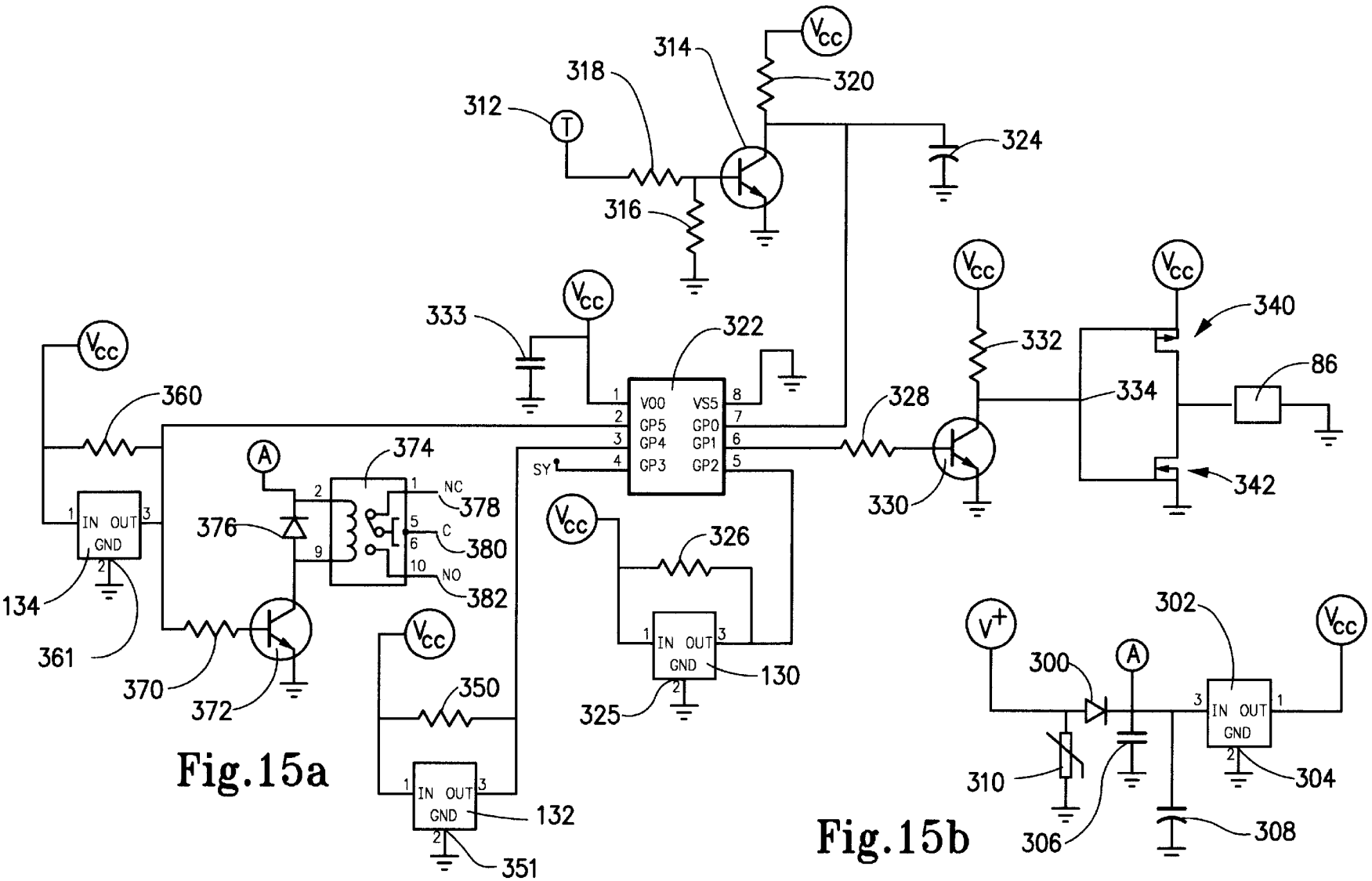
FIGS. 15(*a*) and 15(*b*) are schematic diagrams showing the control and processing circuitry for the door latch actuator according to the present invention and method.

Turning, then, to FIG. 14, it may be seen that the controller 18 is operative to control the operation of door latch actuator 10 over a cycle of operation. As is shown in FIG. 14, at the start of the cycle, a trigger signal is activated at 200 with the door latch actuator 10 being in an initial state.

In the initial state, the door is fastened so that the spring latch bolt is in the engaged position and the dead latch bolt pin is in the disable position. Here, the spring latch plunger is in the retracted position and the dead latch plunger is in the advanced position. The presence of the trigger signal activates a timer at 201 to instruct motor 86 to begin operation. However, controller 18 determines, at 202, if the spring latch plunger is in the retracted position, that is, is the latch monitoring Hall effect device 134 electrically low. If it is not, this inquiry is continued until such time that it is determined that the spring latch plunger is retracted or a time expires. Accordingly, if both a time out has not occurred and the spring latch plunger is retracted, motor 86 operates. However, if the drive time elapses without the actuator detecting that the spring latch plunger is retracted, as shown at 204, the cycle immediately ends at 224.

When it is determined that the spring latch plunger is retracted, motor 86 is actuated for any remainder of the drive interval of time, as is shown at 206. The motor is actuated until the first of two occurrences take place. If Hall effect device 130 becomes active due to the movement of magnet 120 into an adjacent position thereto, motor 210 stops. Alternatively, if the drive interval of time is completed before Hall effect device 130 senses magnet 120, motor 210 is automatically stopped. This reduces the likelihood that motor 86 will burn out should the actuator device 10 become jammed. The drive interval is preferably 300 milliseconds. This operating time of about 300 milliseconds comprises a first interval of time during which the dead latch plunger moves from the advanced position to the withdrawn position and a second interval of time during which the spring latch plunger is driven from the retracted position to the extended position. During the second interval, the dead latch plunger is also driven from the withdrawn position to the advanced position.

Controller 18 next inquires to determine whether the trigger signal is still on or off, at 214. The duration during which the trigger signal is present defines a third or "dwell interval" of time during which the spring latch plunger is extended and the dead latch plunger is advanced. When the trigger is deactivated so that the dwell interval of time ends, controller 18 next starts motor 86 for a fourth interval of time, as is shown at 216. The typical duration of the fourth interval of time is 100 milliseconds. The motor is stopped, at 218, upon the occurrence of the first one of two events. If Hall effect device 132 detects the presence of magnet 120, as is shown at 220, motor 86 is stopped and the cycle ends at 224. However, as is shown at 222, the motor 86 is stopped even if Hall effect device 132 has not detected the presence of magnet 120 when the timing cycle (set at 0.5 seconds) expires. This again protects the motor 86 in the event the plungers are somehow jammed. The stopping of motor 86 at 218 then corresponds to the completion of an actuation cycle, as is shown as 224.

In order to control door latch actuator 10, it is helpful that controller 18 comprise circuitry that is mounted in housing 16. To this end, as noted above, the circuitry for controller 18 may be positioned on a circuit board 150. The circuit diagram for controller 18 is shown in FIGS. 15(*a*) and 15(*b*). Turning first to FIG. 15(*b*), it may be seen that power for the system, V+, may be 12 or 24 volts. This power source is connected through a diode 300 to the input of a regulator 302 that has an output of "$V_{cc}$" which is preferably 5 volts. The regulator is grounded, at 304, and its input is connected to ground through a pair of capacitors 306 and 308. Input power is connected to ground through a varistor 310 for protection of circuit components.

Turning, then, to FIG. 15(*a*), when a trigger signal is generated at 312, signaling the controller to start an actuation cycle, this signal is presented to the base of transistor 314. The base of transistor 314 is connected to ground through a resistor 316 and to trigger signal 312 through a resistor 318. The collector of transistor 314 is connected to $V_{cc}$ through a resistor 320, and to pin 7 of microprocessor 322 and to ground through a capacitor 324 which acts to debounce the signal thereby smoothing out any ringing in the circuit. Prior to the presence of a trigger signal at 312, pin 7 of microprocessor 322 is electrically high. However, when a trigger signal is present, transistor 314 becomes conductive so that pin 7 of microprocessor 322 goes low. A Hall effect device 134 is connected in parallel with a resistor 360 across $V_{cc}$ to pin 2 of processor 322. Hall effect device 134 is grounded at 361. When magnet 140 is adjacent Hall effect device 134, Hall effect device 134 conducts to ground so that pin 2 goes low. This condition allows activation of motor 86 during the drive interval, as described above.

Pin 2 and the output of Hall effect device 134 are also connected to a sub-circuit which includes a resistor 370 connected between the output of Hall device 134 and the base of transistor 372. The emitter of transistor 372 is connected to ground whereas its collector is connected to V+ (12 or 24 volt) through a relay 374. A diode 376 is connected between the collector of transistor 372 and V+ and is biased in a direction to prevent a kickback current from the relay coil of relay 374. Relay 374 has a plurality of outputs 378, 380 and 382 which provide dry contacts for information regarding the status of actuator 10.

Thus, provided that both Hall effect device 134 is low (spring latch plunger 52 is retracted) and the drive interval has not timed out, motor 86 will operate for the duration of the drive interval. This internal timer of microprocessor 322 preferably sets the time limit of the drive interval at 1.5 seconds, as noted above, although the actual time taken by motor 86 to reciprocate the dead latch plunger 62 and extend spring latch plunger 52 is preferred to be about 300 milliseconds.

Activation occurs when both pin 2 and pin 7 of microprocessor 322 are low. In such event, pin 6 goes high thus presenting a signal to the base of transistor 330. The emitter of transistor 330 is connected to $V_{cc}$ through a resistor 332 and its collector is grounded. When pin 6 goes high, transistor 330 becomes conductive and point 334, which is normally high, goes electrically low. A pair of field effect transistors 340 and 342 are connected between $V_{cc}$ and ground in a push/pull circuit. When the gate of transistor 340 goes low, motor 86 therefore is activated.

Pin 5 of microprocessor 322 is connected to $V_{cc}$ through a resistor 326 that is in parallel with Hall effect device 130. Hall device 130 has an input connected to $V_{cc}$ and is grounded at 325. When Hall effect device 130 becomes active due to the presence of magnet 120, pin of processor 322 goes electrically low. When pin 5 of processor 322 goes low, pin 6 also goes low to turn off transistor 330 even though the drive interval has not timed out.

At the completion of the drive interval, microprocessor 322 undergoes a third timing interval or "dwell interval" defined by the presence of the trigger signal. After this dwell interval, the microprocessor 322 will again activate motor 86 for fourth "return interval" of time which resets actuator 10 to the initial starting condition. Motor 86 operates until the earlier of the timed return interval elapses or until magnet 120 is adjacent Hall effect device 132.

The identification and values of the various components described with respect to FIGS. 15(*a*) and 15(*b*) along with designation of the manufacturer, in some instances, are set forth in the following Table Table I:

TABLE I

| Resistors | |
|---|---|
| Element | Value (in Ohms) |
| 316 | 3.3K |
| 318 | 3.3K |
| 320 | 3.3K |
| 326 | 3.3K |
| 328 | 3.3K |
| 332 | 3.3K |
| 350 | 3.3K |
| 360 | 3.3K |
| 370 | 3.3K |
| **Capacitors** | |
| Element | Value |
| 306 | 0.1 μF (50V) |
| 308 | 220 μF |
| 324 | 10 μF (50V) |
| 333 | 0.1 μF (50V) |
| **Diodes** | |
| Element | Component |
| 300 | IN4007 |
| 376 | IN4007 |
| **Transistors** | |
| Element | Component |
| 314 | NPN PN2222A |
| 330 | NPN PN2222A |
| 340 | P Channel IRF952IC |
| 342 | N Channel BUZ71A |
| 372 | NPN PN2222A |
| **Miscellaneous** | |
| Varistor 310 | ERZ-C07DK270 |
| Regulator 302 | MC78L05ACP |
| Microprocessor 322 | PIC12C508-04I/P (Microchip) |
| Hall Effect Devices (130, 132, 134) | A3141 ELL (Allegro) |
| Relay 374 | 12V GSV-1-DC 12 (Omron) |
| Motor 86 | FC-260SA-18130 (Mabuchi) |

From the foregoing, it may be appreciated that the present invention contemplates a method for actuating a latch bolt assembly on a door wherein the latch bolt assembly includes a spring latch bolt and a dead latch bolt pin of the type described above. According to the method, the spring latch bolt and the dead latch bolt pin are received in an actuator that is provided with a spring latch plunger which engages the spring latch bolt and with a dead latch plunger which engages the dead latch bolt pin in such a manner that the spring latch bolt is allowed to move into the engaged position and the dead latch bolt pin is held in the disabled position. Here, the spring latch plunger is reciprocal between an extended position and a retracted position and the dead latch plunger reciprocal between an advanced position and a withdrawn position to define an initial fastened state.

Next, the dead latch plunger is mechanically driven from the advanced position to the withdrawn position during a first interval of time so that the dead latch bolt pin may move from the disabled position to the enabled position to define an intermediate state. Next, the spring latch plunger is mechanically driven over a second interval of time from the retracted position to the extended position so as to move the spring latch bolt from the engaged position to the release position to define the released state.

The method of this invention can include the step of mechanically driving the dead latch plunger from the withdrawn position to the advanced position contemporaneously with the driving of the spring latch plunger during the second interval of time. The method also can include the step of returning the actuator to the initial state during a fourth or "return interval" of time.

The method according to this invention, preferably includes the step of monitoring the spring latch plunger to determine if it is in the extended position or the retracted position. Here, the method may include the step of preventing the mechanical driving of the dead latch plunger at the start of the first interval of time if the spring latch plunger is not in the retracted position. The method may also include the step of preventing the actuator from returning to the initial state if the spring latch plunger is not in the retracted position after the third or dwell interval of time.

It should be further understood that the method according to the present invention includes the step of timing a drive interval, during which the dead latch plunger and the spring latch plunger are to be mechanically driven, that is longer than the anticipated drive time while monitoring their position. This anticipated drive time equals the sum of the first and second intervals, noted above. The method also includes disabling the mechanical drive at the end of the drive interval even if the spring latch plunger has not reached the release position as a protective step to prevent damage to the mechanical drive. The normal or anticipated drive time to mechanically drive the two plungers is selected to be about 300 milliseconds, and the drive time is selected to be about 1.5 seconds. The anticipated drive time equals a 340° rotation of gear 96 by motor 86.

Likewise the method includes the step of timing a return interval that is anticipated to be longer than the actual return time. Where the mechanical drive of the two plungers for a 340° rotation of gear 96 is 300 milliseconds, it is anticipated that the plungers would return to the start cycle position in about 100 milliseconds (20° rotation). Therefore, the timed return interval may be conveniently selected to be about 0.5 seconds. This step then includes monitoring the position of the spring latch and dead latch plungers and deactivating the mechanical drive at the end of the return interval even if the plungers have not reached the start cycle position.

Accordingly, the present invention has been described with some degree of particularity directed to the exemplary embodiment(s) of the present invention. It should be appreciated, though, that the present invention is defined by the following claims construed in light of the prior art so that modifications or changes may be made to the exemplary embodiment(s) of the present invention without departing from the inventive concepts contained herein.

We claim:

1. A door latch actuator adapted to engage a latch bolt assembly on a door to retain the door in a fastened state wherein said latch bolt assembly includes a spring latch bolt reciprocally movable between an engage position such that it can engage the door latch actuator and a release position wherein the door is released from the fastened state and a dead latch bolt pin having a thickness and being reciprocally movable between an enable position that permits movement of the spring latch bolt from the engage position to the release position and a disable position which prohibits movement of the spring latch bolt from the engage position to the release position, said spring latch bolt and said dead latch bolt pin resiliently biased into the engage position and the enable position, respectively, said door latch actuator comprising:

(a) a housing having a forwardly opening latch cavity formed therein that is sized and adapted to receive said spring latch bolt and said dead latch bolt pin when the door is in the fastened state;

(b) a spring latch plunger mounted for linear reciprocal movement in a longitudinal throw direction in said housing between an extended position and a retracted position, said spring latch plunger including a portion disposed in the latch cavity that is operative to engage said spring latch bolt when the door is in the fastened state and be biased thereby into the retracted position;

(c) a dead latch plunger mounted for linear reciprocal movement in the longitudinal throw direction in said housing between an advanced position and a withdrawn position, said dead latch plunger including a portion disposed in the latch cavity that is operative to engage said dead latch bolt pin when in the fastened state; and (d) a rotary drive including a crank operative to reciprocally drive said dead latch plunger from the advanced position to the withdrawn position during a rotary cycle thereof and operative to positively advance said spring latch plunger from the retracted position to the extended position during a portion of the cycle thereof.

2. A door latch actuator according to claim 1 wherein said rotary drive operates during the rotary cycle thereof first to drive said dead latch plunger from the advanced position to the withdrawn position and next to drive said spring latch plunger from the retracted position to the extended position.

3. A door latch actuator according to claim 2 wherein said rotary drive operates to continuously drive said dead latch plunger between the advanced and withdrawn positions during the rotary cycle thereof.

4. A door latch actuator according to claim 1 wherein said spring latch plunger has a front face that is operative to contact said spring latch bolt and wherein said dead latch plunger has a front surface that is operative to contact said latch bolt when said door is in the fastened state, each of said front face and said front surface being oriented at a small acute angle to a latch plane that is perpendicular to the throw direction.

5. A door latch actuator according to claim 4 including a strike plate disposed on said housing and oriented perpendicularly to the throw direction.

6. A door latch actuator according to claim 1 wherein said spring latch plunger has a front face that is operative to contact said spring latch bolt and wherein said dead latch plunger has a front surface that is operative to contact said dead latch bolt pin when said door is in the fastened state, each of said front face and said front surface having a channel formed therein.

7. A door latch actuator according to claim 1 wherein said spring latch plunger has a front face that is operative to contact said spring latch bolt and wherein said dead latch plunger has a front surface that is operative to contact said dead latch bolt pin when said door is in the fastened state, said dead latch plunger having a lip disposed adjacent to the front surface and facing said spring latch plunger, said spring latch plunger having a shoulder sized and oriented to engage said lip.

8. A door latch actuator according to claim 1 wherein said housing includes a chamber having parallel top and bottom walls and parallel side walls, said spring latch plunger and said dead latch plunger formed as rectangular blocks nested in said chamber for guided movement thereby, said chamber communicating with the latch cavity.

9. A door latch actuator according to claim 8 wherein said spring latch plunger has a recess sized and adapted to receive a crank, said crank being disposed in the recess for rotational movement about a rotation axis.

10. A door latch actuator according to claim 9 wherein said crank includes a drive pin oriented parallel to the rotation axis yet offset therefrom, each of said spring latch plunger and said dead latch plunger having slotted openings engaged by said drive pin.

11. A door latch actuator according to claim 1 wherein said rotary drive includes a motor and a worm gear drive.

12. A door latch actuator according to claim 1 including a rotation sensor for detecting a rotational position of said crank during the rotary cycle thereof.

13. A door latch actuator according to claim 1 including a sensor for detecting the position of said spring latch plunger.

14. A door latch actuator adapted to engage a latch bolt assembly on a door to retain the door in a fastened state wherein said latch bolt assembly includes a spring latch bolt reciprocally movable between an engage position such that it can engage the door latch actuator and a release position wherein the door is released from the fastened state and a dead latch bolt pin reciprocally movable between an enable position that permits movement of the spring latch bolt from the engage position to the release position and a disable position which prohibits movement of the spring latch bolt from the engage position to the release position, said spring latch bolt and said dead latch bolt pin resiliently biased into the engage position and the enable position, respectively, said door latch actuator comprising:

(a) a housing having a forwardly opening latch cavity formed therein that is sized and adapted to receive said spring latch bolt and said dead latch bolt pin when in the fastened state;

(b) a strike plate disposed on said housing and having an opening that registers with the latch cavity to define a mouth therefor;

(c) a spring latch plunger mounted in said housing and including a portion disposed in the latch cavity that terminates in a front face that is operative to contact said spring latch bolt when the door is in the fastened state, said spring latch plunger reciprocally movable between an extended position wherein said front face is coextensive with the opening in said strike plate and a retracted position wherein said front face is retracted into the latch cavity;

(d) a dead latch plunger mounted in said housing and including a portion disposed in the latch cavity that terminates in a front surface operative to contact said dead latch bolt pin when the door is in the fastened state, said dead latch plunger reciprocally movable between an advanced position wherein said front surface is coextensive with the opening in said strike plate and a withdrawn position wherein said front surface is retracted into the latch cavity, said dead latch plunger having a side surface operative to abut said spring latch bolt when both said dead latch plunger is in the advanced position and when said spring latch plunger is in the retracted position thereby to retain the door in the fastened state;

(e) a rotary crank disposed in said housing for rotation about a crank axis during a drive cycle, said rotary crank including a drive pin radially offset from said crank axis and extending parallel thereto, each of said spring latch plunger and said dead latch plunger having slotted openings which receive said drive pin, the slotted opening of said dead latch plunger configured such that said dead latch plunger is driven from the advanced position and the withdrawn position during a first portion of the drive cycle and wherein said spring latch plunger is driven from the retracted position to the extended position during a second portion of the drive cycle; and (f) a drive for rotatably driving said rotary crank.

15. A door latch actuator according to claim 14 wherein said front face and said front surface are oriented at an acute angle with respect to a latch plane that is parallel to said strike plate.

16. A door latch actuator according to claim 14 wherein the slotted opening in said spring latch plunger is L-shaped in configuration.

17. A door latch actuator adapted to engage a latch bolt assembly on a door to retain the door in a fastened state wherein said latch bolt assembly includes a spring latch bolt reciprocally movable between an engage position such that it can engage the door latch actuator and a release position wherein the door is released from the fastened state and a dead latch bolt pin reciprocally movable between an enable position that permits movement of the spring latch bolt from the engage position to the release position and a disable position which prohibits movement of the spring latch bolt from the engage position to the release position, said dead latch bolt pin having a selected thickness, said spring latch bolt and said dead latch bolt pin resiliently biased into the engage position and the enable position, respectively, said door latch actuator comprising:

(a) a housing having a forwardly opening latch cavity formed therein that is sized and adapted to receive said spring latch bolt and said dead latch bolt pin when the door is in the fastened state;

(b) a spring latch plunger mounted for reciprocal movement in said housing between an extended position and a retracted position, said spring latch plunger including a portion disposed in the latch cavity that is operative to engage said spring latch bolt when the door is in the fastened state and be biased thereby into the retracted position;

(c) a dead latch plunger mounted for reciprocal movement in said housing along a longitudinal axis between an advanced position and a withdrawn position, said dead latch plunger including a portion disposed in the latch cavity that terminates in a front surface that is operative to engage said dead latch bolt pin when in the fastened state, said dead latch plunger having a side surface operative to abut said spring latch bolt when both said dead latch plunger is in the advanced position and when said spring latch plunger is in the retracted position thereby to retain the door in the fastened state, said dead latch plunger having a thickness in a direction transverse to the longitudinal axis that is greater than the thickness of said dead latch bolt pin; and (d) a rotary drive operative to reciprocally drive said dead latch plunger between the advanced and withdrawn positions and operative to positively advance said spring latch plunger from the retracted position to the extended position.

18. A method of actuating a latch bolt assembly on a door wherein the latch bolt assembly includes a spring latch bolt reciprocally movable between an engage position and a release position and a dead latch bolt pin reciprocally movable between an enable position that permits movement of the spring latch bolt from the engage position to the release position and a disable position that prohibits movement of the spring latch bolt from the engage position to the release position, said spring latch bolt and said dead latch bolt pin resiliently biased into the engage position and the enable position, respectively, comprising the steps of:

(a) receiving said spring latch bolt and said dead latch bolt pin in an actuator that is provided with a spring latch plunger which engages said spring latch bolt and with a dead latch plunger which engages said dead latch bolt pin in such a manner that the spring latch bolt is allowed to move into the engage position and the dead latch bolt pin is held in the disable position, said spring latch plunger linearly reciprocal between an extended position and a retracted position and said dead latch plunger linearly reciprocal between an advanced position and a withdrawn position to define an initial fastened state;

(b) providing a rotary drive that is coupled to the dead latch plunger and the spring latch plunger;

(c) mechanically driving the dead latch plunger over a first interval of time whereby said dead latch plunger undergoes linear movement from an advanced position to the withdrawn position so that said dead latch bolt pin may move from the disable position to the enable position to define an intermediate state;

(d) mechanically driving the spring latch plunger over a second interval of time whereby said spring latch plunger undergoes linear movement from the retracted position to the extended position so as to move the spring latch bolt from the engage position to the release position to define a released state;

(e) holding said spring latch plunger in the extended position for a third interval of time; and (f) returning said actuator to the initial state after the third interval of time during a fourth interval of time.

19. The method according to claim 18 including the step of monitoring said spring latch plunger to determine if it is in the extended position or the retracted position.

20. The method according to claim 19 including the step of preventing the mechanical driving of said dead latch plunger at the start of the first interval of time if said spring latch plunger is not in the retracted position.

21. The method according to claim 18 wherein said first and second intervals of time aggregate to approximately 300 milliseconds.

22. The method according to claim 18 wherein said fourth interval of time is approximately 100 seconds.

* * * * *